US012122583B2

(12) United States Patent
Bergalet

(10) Patent No.: US 12,122,583 B2
(45) Date of Patent: Oct. 22, 2024

(54) PARCEL COMPRISING MEANS FOR RETAINING AT LEAST ONE OBJECT

(71) Applicant: PA.COTTE SA, Pully (CH)

(72) Inventor: Thomas Bergalet, Sainte Luce sur Loire (FR)

(73) Assignee: PA.COTTE SA, Pully (CH)

( * ) Notice: Subject to any disclaimer, the term of this patent is extended or adjusted under 35 U.S.C. 154(b) by 0 days.

(21) Appl. No.: 18/689,572

(22) PCT Filed: Sep. 1, 2022

(86) PCT No.: PCT/EP2022/074402
§ 371 (c)(1),
(2) Date: Mar. 6, 2024

(87) PCT Pub. No.: WO2023/036694
PCT Pub. Date: Mar. 16, 2023

(65) Prior Publication Data

US 2024/0262598 A1 Aug. 8, 2024

(30) Foreign Application Priority Data

Sep. 8, 2021 (FR) ..... 2109419

(51) Int. Cl.
*B65D 81/02* (2006.01)
*B65D 43/16* (2006.01)
*B65D 81/05* (2006.01)

(52) U.S. Cl.
CPC ..... *B65D 81/05* (2013.01); *B65D 43/16* (2013.01); *B65D 2543/00175* (2013.01); *B65D 2581/055* (2013.01)

(58) Field of Classification Search
CPC ..... B65D 5/5028; B65D 43/16; B65D 81/05; B65D 81/07; B65D 81/075; B65D 2543/00175; B65D 2581/051
(Continued)

(56) References Cited

U.S. PATENT DOCUMENTS 4,903,827 A * 2/1990 Phelps ..... B65D 81/075 206/583
5,769,235 A * 6/1998 Keach ..... B65D 81/075 206/583

(Continued)

FOREIGN PATENT DOCUMENTS

CN 109132208 5/2020
FR 3092829 8/2020

(Continued)

OTHER PUBLICATIONS

International Search Report and Written Opinion issued by the International Searching Authority, dated Dec. 5, 2022, for International Patent Application No. PCT/EP2022/074402; 11 pages.

(Continued)

*Primary Examiner* — Luan K Bui
(74) *Attorney, Agent, or Firm* — Faegre Drinker Biddle & Reath LLP

(57) ABSTRACT

The invention relates to a package comprising a crate having a bottom and means for retaining at least one item on the bottom, the retaining means comprising a plate, characterized in that the plate comprises:

a frame to which the return means are connected, and a central part connected to the frame by way of at least one flexible connection, the central part comprising a plurality of plaques connected to the frame by the flexible connection on the one hand and to at least one other plaque by an articulation on the other hand.

11 Claims, 5 Drawing Sheets

(58) Field of Classification Search
USPC ..... 206/583, 588, 591, 592, 594
See application file for complete search history.

(56) References Cited

U.S. PATENT DOCUMENTS

| | | | | |
|---|---|---|---|---|
| 11,731,824 | B2 * | 8/2023 | Cotte | B65D 25/102 206/583 |
| 2022/0002061 | A1 * | 1/2022 | Cotte | B65D 25/102 |
| 2023/0286693 | A1 * | 9/2023 | Cotte | B65D 5/5028 |

FOREIGN PATENT DOCUMENTS

| | | |
|---|---|---|
| FR | 3098506 | 1/2021 |
| KR | 101528420 | 6/2015 |
| WO | 2020/104339 | 5/2020 |

OTHER PUBLICATIONS

English translation of International Search Report issued by the International Searching Authority, dated Dec. 5, 2022, for International Patent Application No. PCT/EP2022/074402; 2 pages.

* cited by examiner

PARCEL COMPRISING MEANS FOR RETAINING AT LEAST ONE OBJECT

CROSS-REFERENCE TO RELATED APPLICATIONS

The present application is a national stage entry of International (PCT) Patent Application Number PCT/EP2022/074402, filed Sep. 1, 2022, which claims priority to French Patent Application Number 2109419, filed Sep. 8, 2021, the complete disclosures of which are expressly incorporated herein by reference.

The field of the invention is that of logistics.

More precisely, the invention relates to a package, or a logistics packing means, i.e. a container, for shipping items between two destinations, by means of a package.

To transport an item in complete safety, and securely, packages such as cases or cardboard boxes are known.

In general, packages comprise a crate having a bottom and a peripheral rim which together define an inner volume in which the item to be transported is housed.

The peripheral edge can be movable with respect to the bottom of the crate. In this regard, it comprises several panels that can be folded down on the bottom or in the extension of the bottom of the crate.

Packages also comprise a lid movable with respect to the crate. These lids can in particular take up a closed position in which the lid closes off the inner volume of the crate.

To allow the protection of the transported items, certain packages comprise retaining means for holding the item to be transported in position in the crate.

Retaining means are known which take the form of foam panels incorporated into the crate and into the lid. Foam panels can, where applicable, be added on to the crate. In other words, the foam panels can be incorporated into the crate only if their presence is required.

More precisely, the foam panels are secured to the bottom of the crate, where applicable to its peripheral rim, and to the lid.

The item to be transported is then inserted into the inner volume such as to come into contact with the foam and to be blocked by the foam of the bottom and the foam of the lid.

This type of retaining means has its thickness or, in other words, the overall dimensions it takes up in the inner volume of the crate, as its major drawback.

Specifically, the foam takes up most of the inner volume of the crate. However, the foam has elastic features such as to form retaining means which can deform to fit the outline of the item to be transported.

However, according to the size of the item, several packages must be provided.

For example, the same crate cannot be used for a bulky item and for a small item. In the case of the small item, if a crate or a package suitable for a large item is used, the foam is not suitably deformed on contact with the small item, and the latter can then move about inside the inner volume of the crate, running the risk of becoming damaged.

If, on the contrary, a large item is introduced into the inner volume of a crate intended to contain a small item, the package can become unusable for want of sufficient space in the inner volume, the lid then not being able to be closed successfully such as to completely close off the inner volume of the crate. This results in the item not actually being protected and being visible to anyone transporting the package, which may lead to a risk of the item being stolen.

The transporters or packaging industry professionals must, consequently, possess packages of different sizes according to the size of the items to be transported.

Using another known technique, the retaining means take the form of a plastic envelope inside which the item to be transported is slipped. The envelope is then deformed so that its walls come into contact with the item to be transported and hold this item in its position.

In a first type, the envelopes can be secured to the bottom of the crate and their deformation can be done, for example, by heating so as to shrink the material, generally plastic, so that it stiffens on contact with the item.

A drawback of this solution lies in the fact that the deformation of the envelope, when it is done by heating, cannot be done by anyone since this technique requires the use of specific heating equipment.

Specifically, heating means, such as heat guns for example, must be used and may require special training such that only professionals can deform the envelope.

Moreover, when the envelope is secured to the bottom of the crate, this can be a major drawback for the integrity of the crate, particularly if it is made of cardboard, since excessive heat can destroy the cardboard by burning it.

In addition, the introduction of the item to be transported in the envelope can prove difficult or even impossible.

This is particularly true if the item to be transported is inserted into the envelope once the crate has been shaped, i.e. once the inner volume is defined, the peripheral rim of the crate forming a major barrier to the insertion of the item into the envelope.

To palliate this, it may be necessary, to first insert the item into the envelope, then to shape the crate, and finally to deform the envelope.

This involves significant handling time which can be undesirable to professionals and also be impossible to carry out for private individuals, particularly deforming the envelope or to shaping the crate.

According to a second type, the envelope can also be secured to a plate intended to be housed in the crate. In this case, the item is inserted into the envelope then, in order to secure and retain the item, the envelope is deformed by folding of the edges of the plate, such as to tauten the two walls of the envelope to trap the item. Once this is finished, the folded plate can be inserted into the crate, then the movable lid can be closed on the crate.

These retaining means also have certain drawbacks.

Specifically, although the insertion of the item into the envelope does not pose any problem, the deformation of the plate, particularly the folding of its edges involves handling that is complicated, or even impossible to carry out when the item is bulky and the envelope to be deformed offers resistance to significant deformation. The deformation of the envelope can then become time-consuming and deter professionals who will then make a partial deformation or even offer a larger package, generating a higher transportation cost for the end consumer.

Moreover, this necessitates the simultaneous storage of the crate, the lid and the retaining means, which represents an undesirable total bulk and therefore an excess cost which is often passed on to the end client.

Also known are the addition of crumpled paper, air pillows, card spacers, or else foam balls making it possible to shim the item to be transported inside the package, and to protect it during transportation.

Another technique has been developed to meet the need for retainment of an item in a package, while offering a simplified operating mode by comparison with the known techniques.

This technique makes provision for the retaining means to be secured to the lid and comprise an elastically deformable skin which comes into contact with the item contained in the package, to cover it and hold it against the bottom of the crate.

While such a solution gives satisfaction, it can still be improved.

Specifically, the flexible skin places an applied tension on the item that could damage said item, particularly if the latter is particularly fragile.

Moreover, certain items may have complex shapes for which the elastically deformable skin cannot ensure successful retainment. Thus, it is possible that only a part of the item is retained by the elastically deformable skin while another part remains in free movement inside the package, risking impact with the crate if the package is roughly moved.

Furthermore, when two items of different size must be transported in the same package, it is necessary to retain them both inside the package, which is only possible by way of a spacer or a shim inserted between the two items. This necessitates the addition of weight inside the package and especially the storage of any means that can form a spacer.

In addition, when the package has arrived at its destination, the items are removed and the package can be reused while the spacer no longer has any use and is then thrown away. This has an environmental impact, particularly if the spacer is not thrown away into a recycling circuit or its recycling is not possible.

The invention in particular has the aim of palliating the drawbacks of the prior art.

More precisely, the invention has the aim of making provision for a solution allowing the shimming of at least one item by adapting automatically to the features of each item, particularly in terms of mechanical resistance in relation to its geometry, without damaging said item.

The invention also has the aim of supplying such a solution in a way that is easy to implement for a package sender.

The invention moreover has the aim of supplying such a solution, which has a small bulk when the package is stored between two uses.

These aims, along with others that will become apparent further on, are achieved owing to the invention which has as its subject a package comprising a crate having a bottom and means for retaining at least one item on the bottom, the retaining means comprising:

- a plate, and return means tending to exert a displacement force on the plate in the direction of the bottom to hold said item or items between the bottom and the plate, characterized in that the plate comprises:
- a frame to which the return means are connected, and
- a central part connected to the frame by way of at least one flexible connection,
- and in that the central part comprises a plurality of plaques, each plaque being connected to the frame by the flexible connection on the one hand and to at least one other plaque by an articulation on the other hand.

Such a plate can thus be deformed to fit as closely as possible the shape of each item to be kept on the bottom of the package.

Specifically, the use of a plurality of plates connected to one another by articulations, and connected to the frame by a flexible connection, makes it possible to deform the central part of the plate, such as to be in contact with each item to be held on the bottom of the package.

According to an advantageous aspect, each flexible connection takes the form of at least one elastically deformable gutter.

The use of an elastically deformable gutter makes it possible to vary the position of the central part with respect to the frame in order to deform the central part, which has the result of fitting as closely as possible the outline of each item to be retained on the bottom of the package.

Furthermore, the shape of a gutter makes it possible to create an incipient deformation allowing the unfolding of the flexible connection in order to ensure the mobility of each plate with respect to the frame.

According to another advantageous aspect, at least one of the flexible connections comprises a plurality of gutters abutting one another forming a series of alternating troughs and peaks.

The series of alternating troughs and peaks formed by the plurality of gutters makes it possible to produce an easily deformable flexible connection, of concertina type.

Thus, each of the gutters can be elastically deformed independently of the others so as to adapt the position of the plaque connected to the plate by way of it, and ensure the successful retention of each item on the bottom of the package.

According to another advantageous aspect, each articulation takes the form of at least one elastically deformable gutter.

The use of an elastically deformable gutter makes it possible to vary the position of the central part with respect to the frame in order to deform the central part to fit as closely as possible the outline of each item to be retained on the bottom of the package.

Furthermore, the shape of a gutter makes it possible to create an incipient deformation allowing the unfolding of the flexible connection in order to ensure the mobility of each plaque with respect to the frame.

According to another advantageous aspect, at least one of the articulations comprises a plurality of gutters abutting one another forming a series of alternating troughs and peaks.

The series of alternating troughs and peaks formed by the plurality of gutters makes it possible to produce an easily deformable flexible connection, of concertina type.

Thus, each of the gutters can elastically deform independently of the others, such as to adapt the position of the plaque connecting to the plate by its intermediary, and ensure the successful retention of each item on the bottom of the package.

According to another advantageous aspect, the frame has a rectangular shape and the central part of the plate comprises:

- a central strip including two rectangular plaques connected by a central articulation, and extending between two opposite edges of the frame, and
- on either side of the central strip, four triangular plaques connected in pairs.

Such an architecture of the central part of the plate thus ensures an arch-shaped deformation of the plate to retain one or more items on the bottom of the package.

Specifically, the central articulation can be deformed to fold the two rectangular plaques toward one another, and the triangular plaques can be oriented with respect to one another to configure a dome shape, while using substantially planar plaques.

Thus, each item is perfectly retained on the bottom of the package.

According to another advantageous aspect, the plate is symmetrical about a plane of symmetry passing through the central articulation.

This symmetry makes it possible to control the deformation of the plate and particularly to deform the plate in a dome when the latter is intended to fit the shape of an item to be retained on the bottom of the package.

In other words, the symmetry of the plate makes it possible to center the item with respect to the plate so as to guarantee its successful holding.

According to another advantageous aspect, the central strip extends in a first plane and the triangular plaques extend in a second plane offset with respect to the first plane.

Thus, when the plate comes into contact with several objects to be retained on the bottom of the package, the offset between the first plane and the second plane makes it possible to ensure that the plate is in contact with the item.

Moreover, if the item to be retained on the bottom has height differences, then these height differences can be compensated for by the height difference between the first plane and the second plane.

Finally, when the item to be retained is flat, for example a coin, a magazine or an envelope, the height difference between the central strip and the triangular plaques makes it possible to ensure that the item will be successfully held since at least one of the parts of the plate will be in contact with the item.

According to another advantageous aspect, the plate is made of polypropylene.

The use of polypropylene makes it possible to make an adequate holding of each item on the bottom of the package while offering good rigidity without significantly increasing the weight of the package.

In other words, the use of polypropylene makes it possible to obtain a good retention of the items on the bottom of the package without making this package heavier, which would have an adverse effect on its ease of handling.

According to another advantageous aspect, the crate comprises a peripheral rim extending from the bottom, the package also comprising a lid mounted rotatably on the peripheral rim by a joining edge, the lid being able to take up a crate-closing position, the package moreover comprising a jamb mounted rotatably on the lid, at a distal end opposite the joining edge, the jamb having a free end intended to enter the vicinity of the bottom in the closing position of the lid, the plate being movable along the jamb, and the return means being positioned between the free end of the jamb and the plate.

The presence of the jamb makes it possible to position the plate as close as possible to the bottom when the lid is in its crate-closing position.

Thus, particularly when the frame is located in the vicinity of the bottom, the central part can deform while tending to recover its initial position to press each item flat against the bottom of the package.

Moreover, the positioning of the means of return between the free end of the jamb and the plate makes it possible to attract the plate in the direction of the bottom of the package, which ensures the retention of the items against the bottom of the package by the deformation of the central part of the plate.

Thus, owing to this architecture, the items are held pressed flat against the bottom of the package, automatically.

Other features and advantages of the invention will become more clearly apparent on reading the following description of a preferred embodiment of the invention, given by way of illustrative and non-limiting example, and the appended drawings among which:

Figure 1:
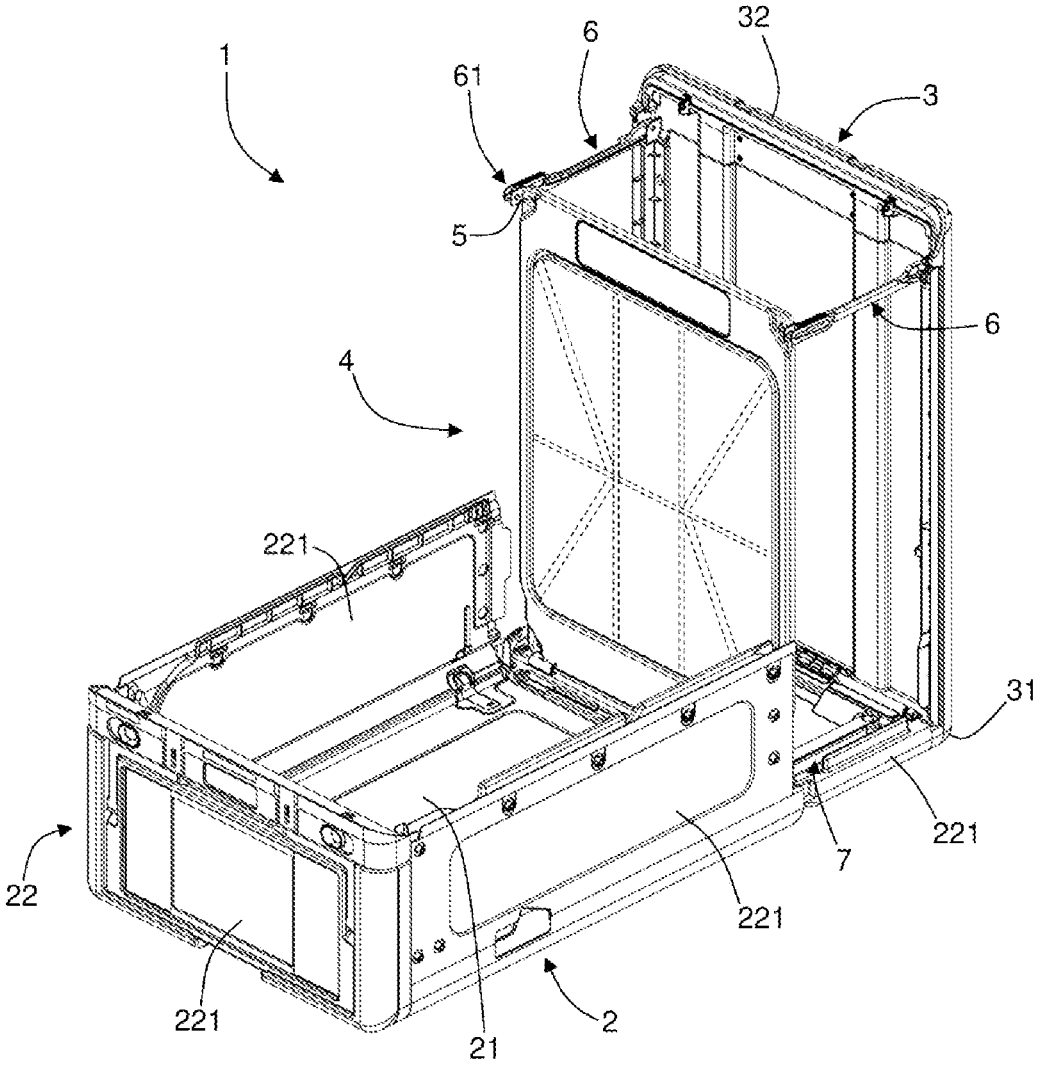
FIG. 1 is a schematic view of a package according to the invention, the package comprising means for retaining an item on its bottom.

With reference to FIG. 1, a package 1 according to the invention is shown.

The package 1 comprises:

a crate 2;

a lid 3 intended to enclose the crate 2;

and means for retaining an item inside the package.

The crate 2 comprises a bottom 21 and a peripheral rim 22 extending from the bottom.

The peripheral rim 22 and the bottom 21 together define a storage volume internal to the crate 2.

The peripheral rim 22 comprises a plurality of panels 221 abutting one another so as to define an enclosed outline.

Each panel 221 is mounted pivotably on the bottom 21 of the crate 2.

Each panel 221 can thus take up a use position in which it extends substantially perpendicular to the bottom 21, and a storage position in which it extends substantially parallel to the bottom 21.

As is illustrated by FIG. 1, the lid 3 is mounted rotatably on one of the panels 221 of the peripheral rim 22.

More precisely, the lid 3 is connected to one of the panels 221 by a joining edge 31 through which it is articulated rotatably to said panel 221.

Opposite the joining edge 31, the lid 3 has a distal end 32.

The lid can pivot with respect to the panel 221 between a first position in which it is substantially perpendicular to the panel 221 on which it is mounted, and a second position in which it is substantially parallel to said panel 221.

In his first position, the lid 3 obstructs the access to the inner storage volume of the crate 2. In other words, in its first position, the lid 3 closes the package 1.

Conversely, in its second position, the lid 3 leaves the access to the inner storage volume of the crate 2 free. In other words, in its second position, the lid 3 opens the package 1.

According to the embodiment illustrated in the figures, the lid 3 is part of a closing-off assembly incorporating the panel 221 on which it is mounted.

Thus, in the first position of the lid 3, the panel 221 is in its use position, and in the second position of the lid 3, the panel 221 is in its storage position.

The retaining means comprise:

a plate 4, and return means 5 tending to exert a displacement force on the plate 4 in the direction of the bottom 21 of the crate 2 as will be explained hereinafter.

As shown in FIG. 1, the package 1 has at least one jamb 6 mounted rotatably on the lid 3 at the level of its distal end 32.

The jamb 6 has a free end 61 intended to enter the vicinity of the bottom 21 in the closing position of the lid 3, i.e. in the second position of the lid 3.

The return means 5 for example take the form of an elastic cord and are positioned between the free end of the jamb 6 and the plate 4.

The plate 4 is thus rotatably movable with respect to the jamb. The plate 4 is moreover translationally guided along the jamb 6 by ad hoc means.

As illustrated by FIG. 1, the package 1 comprises two jambs 6 positioned at the distal end 32 of the lid and mounted rotatably on the lid 3.

The two jambs 6 are positioned in such a way as to be located on either side of the plate 4.

To further guide the plate in its translational movement with respect to the jamb 6, the package 1 comprises means for guiding the plate 4 in its displacement on the panel 221 on which the lid 3 is rotatably mounted.

These means for guiding the plate 4 in its displacement comprise at least one slider 7 in which the panel 4, or at least a part of the panel 4, takes place, making it possible to translationally guide the panel 4 along the panel 221 secured to the joining edge 31 of the lid 3.

The panel 4 is thus translationally movable along a direction of displacement perpendicular to the bottom 21 of the crate 2 and can move away from the bottom 21 and be brought toward the bottom 21 using the return means 5.

With reference to FIGS. 2, 3, 4 and 5, the plate 4 is now described.

The plate 4 comprises:

- a frame 41 to which return means 5 are connected, and
- a central part 42 connected to the frame 41 by way of at least one flexible connection 43.

Figure 2:
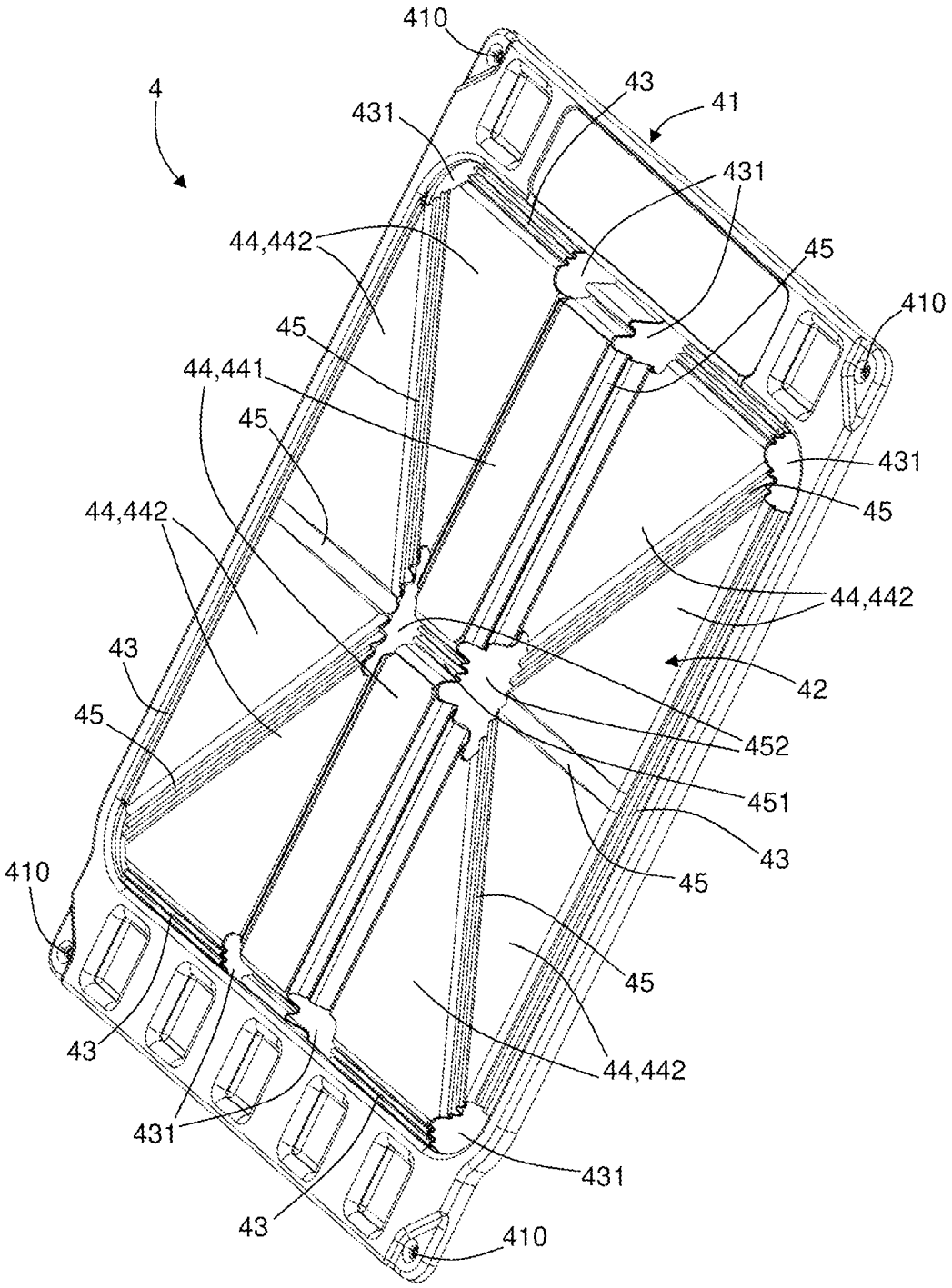
FIG. 2 is a bottom perspective view of a plate of the means for retaining the package according to the invention.

As is illustrated by FIG. 2, the frame 41 has a substantially rectangular shape. At each of its corners, the frame 41 has at least one hole 410 for attaching return means 5.

The central part 42 comprises a plurality of plaques 44.

Each plaque 44 is connected to the frame 41 by the flexible connection 43 on the one hand, and to at least one other plaque 44 by an articulation 45 on the other.

The central part 42 of the plate 4 can thus deform to adapt to each item to be retained in the package 1 as explained hereinafter.

Figure 3:
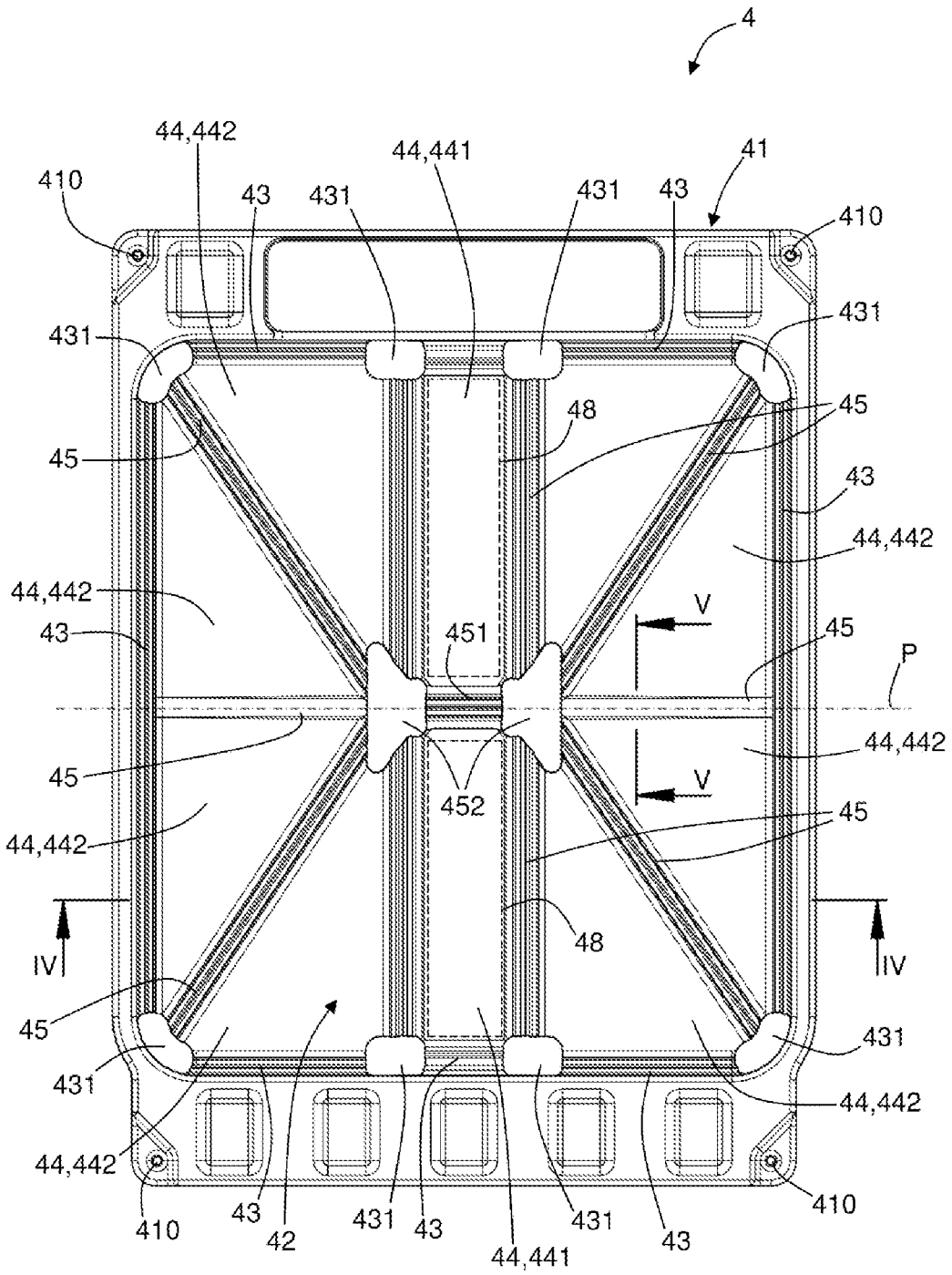
FIG. 3 is a bottom perspective view of a plate of the means for retaining the package according to the invention.

With reference to FIGS. 2 and 3, the central part 42 of the plate 4 comprises:

- a central strip including two rectangular plaques 441 connected by a central articulation 451, and
- on either side of the central strip, four triangular plaques 442 connected in pairs.

The use of rectangular plaques 441 and triangular plaques 442 makes it possible to deform the plate 4 into a dome which tends to recenter each item to be retained toward the center of the plate 4.

The triangular plaques 442 more specifically have a right-angled triangle shape.

The triangular plaques 442 are arranged in pairs in such a way as to form a rectangle together.

Thus, on each side of the central strip, the triangular plaques 442 are positioned so as to form a rectangle extending over the entire length of the central strip.

In other words, the triangular plaques 442 are grouped in fours on either side of the central strip and are disposed such that two triangular plaques 442 are joined to one another by their hypotenuses, via an articulation 45. Furthermore, in this architecture, two triangular plaques 442 are joined to one another, by way of an articulation 45, at the level of their shortest length.

As illustrated by FIGS. 2 and 3, the flexible connection 43 is discontinuous over the periphery of the central part 42.

More particularly, the flexible connection 43 has a plurality of recesses 431 at each join with an articulation 45.

Similarly, each articulation 45, when it encounters a second articulation 45 has an aperture 452.

The apertures 452 and recesses 431 on the one hand facilitate the manufacturing of the plate 4 but also facilitate the deformation of the central part 42 as explained hereinafter without risking tearing due to a concentration of stresses on the flexible connection 43 or on the articulations 45.

With reference to FIG. 3, the plate 4 is symmetric along a plane of symmetry P passing through the central articulation 451.

Thus, as illustrated by FIG. 3, on either side of the plane of symmetry P, the central part 42 of the plate 4 has a rectangular plaque 441 and, on either side of the rectangular plaque 441 two triangular plaques 442.

Figure 4:
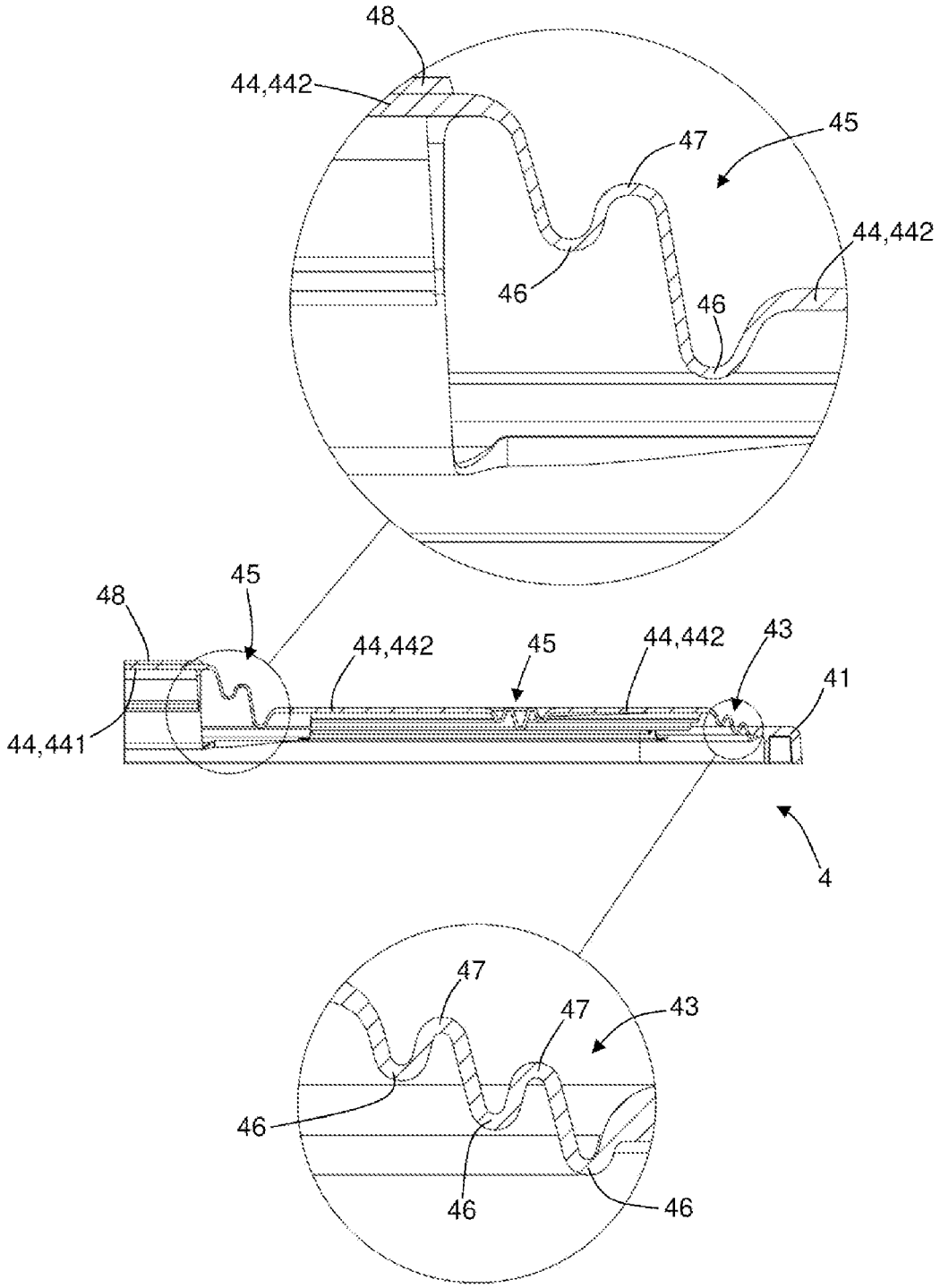
FIG. 4 is a detail view in cross section along the section plane IV-IV of FIG. 3, this view comprising a first magnified detail insert illustrating for a flexible connection, and a second magnified detail insert illustrating an articulation of the means of the plate of the means for retaining the package according to the invention.

With reference to the detail view of FIG. 4, the central strip formed by the two rectangular plaques 441 extends in a first plane P1 and the triangular plaques 442 extend in a second plane P2 offset with respect to the first plane P1.

According to the embodiment illustrated by FIG. 4, the rectangular plaques 441 of the central strip are intended to be closer to the bottom 21 of the package 1 than the triangular plaques 442.

This offset is visible when the panel 4 is not subject to any deformation, i.e. it does not interact with at least one item to be retained in the package 1.

By way of illustrative and non-limiting example, the plate 4 is made of polypropylene.

Advantageously, the plate 4 is transparent.

With reference to FIG. 4, each flexible connection 43 takes the form of at least one elastically deformable gutter.

As is illustrated by the lower detail insert of FIG. 4, at least one of the flexible connections 43 comprises a plurality of gutters abutting one another forming a series of alternating troughs 46 and peaks 47.

More specifically, the flexible connection 43 successively has from the frame 41 to the central part 42, a first trough 46, a first peak 47, a second trough 46, a second peak 47, and finally, a third trough 47.

In other words, the flexible connection 43 comprises two steps.

This series of alternating troughs 46 and peaks 47 makes it possible to deform the plaques 44 independently from one another with respect to the frame 41.

Like the flexible connection 43, each articulation 45 takes the form of at least one elastically deformable gutter.

Figure 5:
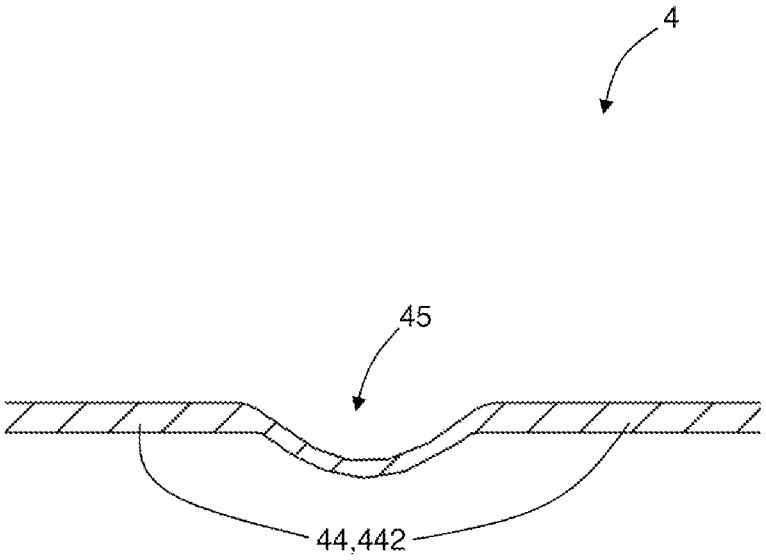
FIG. 5 is a detail view in longitudinal section along the section plane V-V of FIG. 3, illustrating an articulation of the plate of the means for retaining the package according to the invention.

With reference to FIG. 5, the articulation 45 located between two triangular plaques 442 and which extends along the symmetry plane P is a simple articulation.

In other words, the simple articulation is formed of a single gutter.

With reference to the upper detail insert illustrated by FIG. 4, at least one of the articulations 45 comprises a plurality of gutters abutting one another forming a series of alternating troughs 46 and peaks 47.

With reference to the upper detail insert FIG. 4, the articulation 45 illustrated has, from the frame 41 to the central part 42, a first trough 46, a peak 47, and finally a second trough 46.

In other words, the articulation 45 comprises a single step.

According to the embodiment illustrated in FIG. 3, each rectangular plaque 441 bears catching means 48.

These catching means 48 are intended to interact with each item to be retained in the package 1 to prevent them from slipping with respect to the plate 4.

These catching means 48 are for example composed of a strip of material attached to the rectangular plaques 441.

The catching feature of the catching means 48 can be obtained either by the use of a material of a roughness offering the desired catching, or by using an anti-friction material having anti-friction features retaining the items, or by using a material having a repositionable adhesive coat.

In use, the package 1 according to the invention makes it possible to retain one or more items against the bottom 21 of the crate 2 by way of the plate 4 of the retaining means.

To transport an item in complete safety, a user positions the item to be transported on the bottom 21 of the crate 2 then positions the lid 3 in its closing position (i.e. its first position).

The plate 4, which is connected to the jamb 6, then rises in the direction of the lid 3 while being separated from the bottom 21 of the crate 2 by the presence of the item to be retained in the crate 2.

The return means 5 then tend to exert a displacement force on the plate 4 in the direction of the bottom 21 to hold each item between the bottom 21 of the crate 2 and the plate 4.

By this force, the displacement of the plate 4 toward the bottom 21, the central part 42 of the plate 4 deforms to fit as closely as possible the shape of each item to be retained in the crate 2.

This deformation of the central part 42 is particularly obtained using the articulations 45 and each flexible connection 43.

Thus, the plaques 44 are oriented according to the shape of the item or items to be retained independently from one another, which allows the plate 4 and particularly its central part 42 to fit the item or items to be retained and to press these items flat against the bottom 21 of the crate 2.

The package 1 that has just been described thus offers the effective retainment of each item inside the package 1 during their transportation, which ensures they remain intact.

Furthermore, the use of a material such as polypropylene makes it possible to produce a plate 4 ensuring the holding of the items against the bottom 21 of the crate 2 simply and without making the package 1 significantly heavier.

The invention claimed is:

1. A package comprising a crate having a bottom and means for retaining at least one item on the bottom, the retaining means comprising:

a plate, and return means tending to exert a displacement force on the plate in the direction of the bottom to hold said item or items between the bottom and the plate, wherein the plate comprises:

a frame to which the return means are connected, and a central part connected to the frame by way of at least one flexible connection, and in that the central part comprises a plurality of plaques, each plaque being connected to the frame by the flexible connection on the one hand and to at least one other plaque by an articulation on the other hand.

2. The package of claim 1, wherein each flexible connection takes the form of at least one elastically deformable gutter.

3. The package of claim 1, wherein at least one of the flexible connections comprises a plurality of gutters abutting one another forming an alternation of troughs and peaks.

4. The package of claim 1, wherein each articulation takes the form of at least one elastically deformable gutter.

5. The package of claim 4, wherein at least one of the articulations comprises a plurality of gutters abutting one another forming a series of alternating troughs and peaks.

6. The package of claim 1, wherein the frame has a rectangular shape, and in that the central part of the plate comprises:

a central strip including two rectangular plaques connected by a central articulation, and extending between two opposite edges of the frame, and on either side of the central strip, four triangular plaques connected in pairs.

7. The package of claim 6, wherein the plate is symmetrical about a plane of symmetry (P) passing through the central articulation.

8. The package of claim 6, wherein the central strip extends in a first plane (P1) and the triangular plaques extend in a second plane (P2) offset with respect to the first plane (P1).

9. The package of claim 7, wherein the central strip extends in a first plane (P1) and the triangular plaques extend in a second plane (P2) offset with respect to the first plane (P1).

10. The package of claim 1, wherein the plate is made of polypropylene.

11. The package of claim 1, wherein the crate comprises a peripheral rim extending from the bottom, the package also comprising a lid mounted rotatably on the peripheral rim by a joining edge, the lid being able to take up a crate-closing position, the package moreover comprising a jamb mounted rotatably on the lid, at a distal end opposite the joining edge, the jamb having a free end intended to enter the vicinity of the bottom in the closing position of the lid, the plate being movable along the jamb, and the return means being positioned between the free end of the jamb and the plate.

* * * * *